US006330395B1

(12) United States Patent
Wu

(10) Patent No.: US 6,330,395 B1
(45) Date of Patent: Dec. 11, 2001

(54) HEATING APPARATUS WITH SAFETY SEALING

(76) Inventor: Chia-Hsiung Wu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/474,268

(22) Filed: Dec. 29, 1999

(51) Int. Cl.[7] ..... F24H 1/10; H05B 3/78
(52) U.S. Cl. ..... 392/494; 392/484
(58) Field of Search ..... 392/465, 467, 392/479, 48 D, 484, 490, 494

(56) References Cited

U.S. PATENT DOCUMENTS 3,782,456 * 1/1974 Gusmer ..... 165/164
4,255,646 * 3/1981 Dragoy et al. ..... 392/396
4,334,141 * 6/1982 Roller et al. ..... 392/467
4,371,777 * 2/1983 Roller et al. ..... 392/480
5,724,478 * 3/1998 Thweatt ..... 392/484

* cited by examiner

*Primary Examiner*—Teresa Walberg
*Assistant Examiner*—Thor Campbell
(74) *Attorney, Agent, or Firm*—Dougherty & Troxell

(57) ABSTRACT

A fluid type heating apparatus with safety sealing has a metallic heat exchanging main body, a heating unit embedded within the metallic heat exchanging main body, a plurality of fluid conduits extended along the lengthwise direction of the metallic heat exchanging main body, a groove at the center of the metallic heat exchanging main body and housing the heating unit enclosed by an insulating layer, a front cover at front side of the metallic heat exchanging main body and a rear cover at rear side of the metallic heat exchanging main body. The front and rear cover has a plurality of guiding slots coupled to the conduit to control circulation of the fluid.

5 Claims, 5 Drawing Sheets

HEATING APPARATUS WITH SAFETY SEALING

BACKGROUND OF THE INVENTION

1) Field of the Invention

The present invention relates to a heating apparatus with safety sealing, particular to a heating apparatus, which uses fluid to conduct thermal energy and has safety sealing.

2) Description of the Prior Art

The conventional fluid type heating apparatus generally comprises a heating means with an electrothermal metal enclosed by insulating envelope and immersed into a fluid. The heat generated by the heating means is conducted through the fluid the outer case of the fluid type heating apparatus or transmitted to body directly heat exchange with the fluid. However, the fluid used for the fluid type heating apparatus is required to accumulation or circulation for specific application, the overall machine size is bulky. Moreover, the temperature distribution may be nonuniform when the fluid is not uniformly circulated. The electrothermal metal used in the heating means has high temperature about 500° C., the insulating envelope made of material such as mica is liable to crack and short-circuit problem may occur.

SUMMARY OF THE INVENTION

The present invention is intended to overcome above problems. In one aspect of the present invention, the inventive fluid type heating apparatus with safety sealing comprises a metallic heat exchanging main body, a heating means embedded within the metallic heat exchanging main body, a plurality of fluid conduits extended along the lengthwise direction of the metallic heat exchanging main body, a groove at the center of the metallic heat exchanging main body and housing the heating means enclosed by an insulating layer, a front cover at front side of the metallic heat exchanging main body and a rear cover at rear side of the metallic heat exchanging main body. The front and rear cover has a plurality of guiding slots coupled to the conduit to control circulation of the fluid.

In another aspect of the present invention, the conduit is integrally formed by a serpentine shape tube to reduce fluid resistance.

In still another aspect of the present invention, the metallic heat exchanging main body has two deformable parts on lateral sides thereof such that the heating means can be firmly retained.

In still another aspect of the present invention, the metallic heat exchanging main body has thread groove to facilitate the disassembling thereof.

The various objects and advantages of the present invention will be more readily understood from the following detailed description when read in conjunction with the appended drawing, in which:

DETAILED DESCRIPTION OF THE PREFERRED EMBODIMENTS

Figure 1:
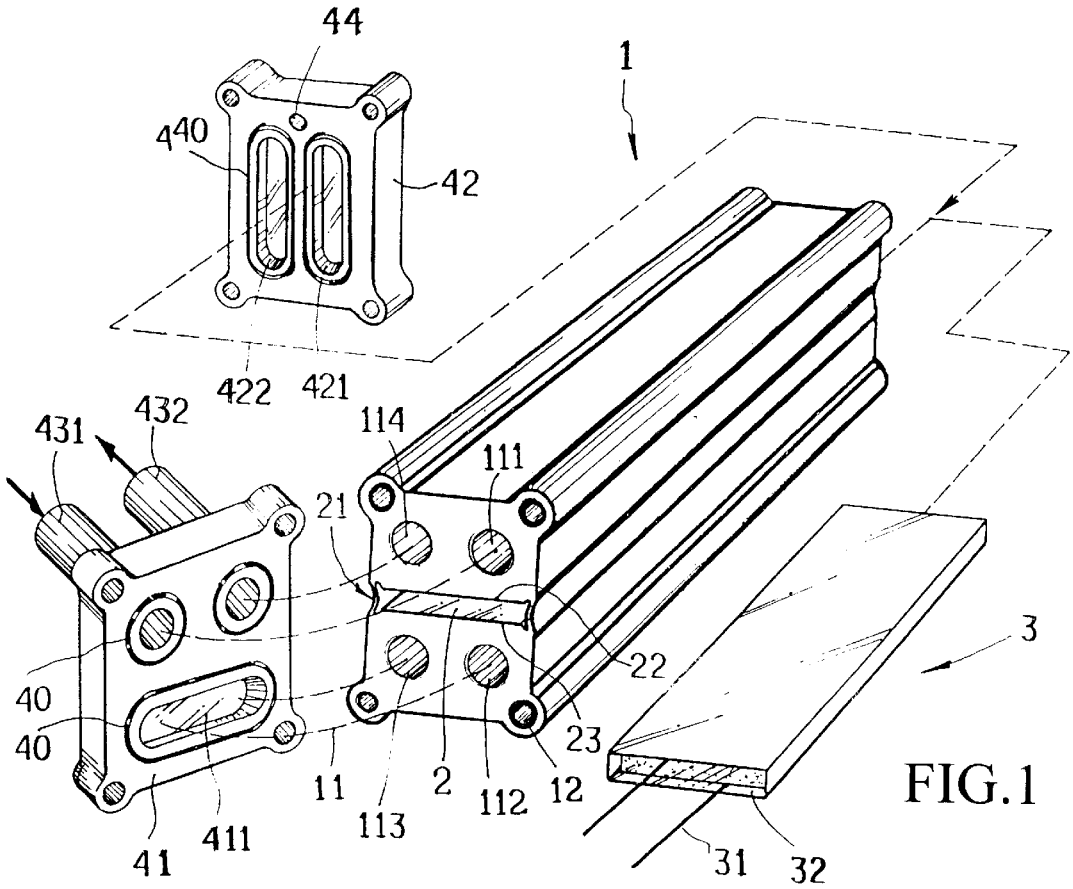
FIG. 1 is the perspective view of the present invention.

The present invention is intended to provide a fluid type heating apparatus with safety sealing. The fluid type heating apparatus, as shown in FIG. 1, comprises a metallic main body 1; a groove 2 within the metallic main body 1 and extending along the same direction as the fluid flowing direction; a heating unit 3 embedded within the groove 2. The metallic main body 1 is of long strip shape and has at least two fluid conduits 11 therein. Moreover, the metallic main body 1 has a plurality of thread grooves 12 on four corners thereof for assembling thereof, and has two deformed portion 21 on lateral sides of the metallic main body 1 and beside the groove 2.

The embedded heating unit 3 is a ceramic resistor plate and connected to an electric power through a conductive wire 31. The embedded heating unit 3 is sealed by an insulating layer 32. It should be noted that the overall size of the embedded heating unit 3 is smaller than the accommodating space of the groove 2.

The heating unit 3 is embedded into the groove 2 and then the metallic main body 1 is pressed on top and bottom sides thereof. The deformable portion 21 beside the groove 2 are deformed such that the upper pressing surface 22 and the lower pressing surface 23 of the groove 2 press on the top and bottom surface of the heating unit 3 and clamp the heating unit 3.

A front cover 41 and a rear cover 42 are assembled on front end and rear end of the metallic main body 1. The front cover 41 has an inlet 431 and an outlet 432 corresponding to the conduit 11 and a guiding slot 411 for circulating fluid. The rear cover 42 has guiding slots 421 and 422 corresponding to the conduit 11 and a hole 44 for the passing through of the 44. The front cover 41 and the rear cover 42 are used to seal the front end and rear end of the groove 2 and the main body 1. Moreover, the cover 41 and the rear cover 42 have washer 40 between itself and the surface of the main body 1 to prevent fluid leakage. The guiding slots are such arranged that the fluid is entered from the inlet 431 and flows through the first conduit 111. The fluid flows to the rear cover 42 and is guided to the second conduit 112 by the guiding slot 421. The fluid circulated from the second conduit 112 flows to the guiding slot 411 and is guided to the third conduit 113. The fluid flowing in the third conduit 113 is circulated to the guiding slot 422 and guided to the fourth conduit 114 and the outlet 432. By above mentioned circulation scheme of the fluid, the heat energy generated by the heating unit 3 can be uniformly absorbed by the fluid. Moreover, the fluid resistance and the heat dissipation can be reduced. The heating unit 3 is made of ceramic resistor and has the property of constant temperature and fireless radiation. The heating unit 3 is enclosed by insulating material and maintains at about 200° C. working temperature.

Moreover, the front cover 41 and the rear cover 42 can be alternatively configured such that the fluid circulation path is varied. It should be noted that the front cover 41 and the rear cover 42 should be used with a plurality of conduits to control the fluid circulation path.

Figure 8:
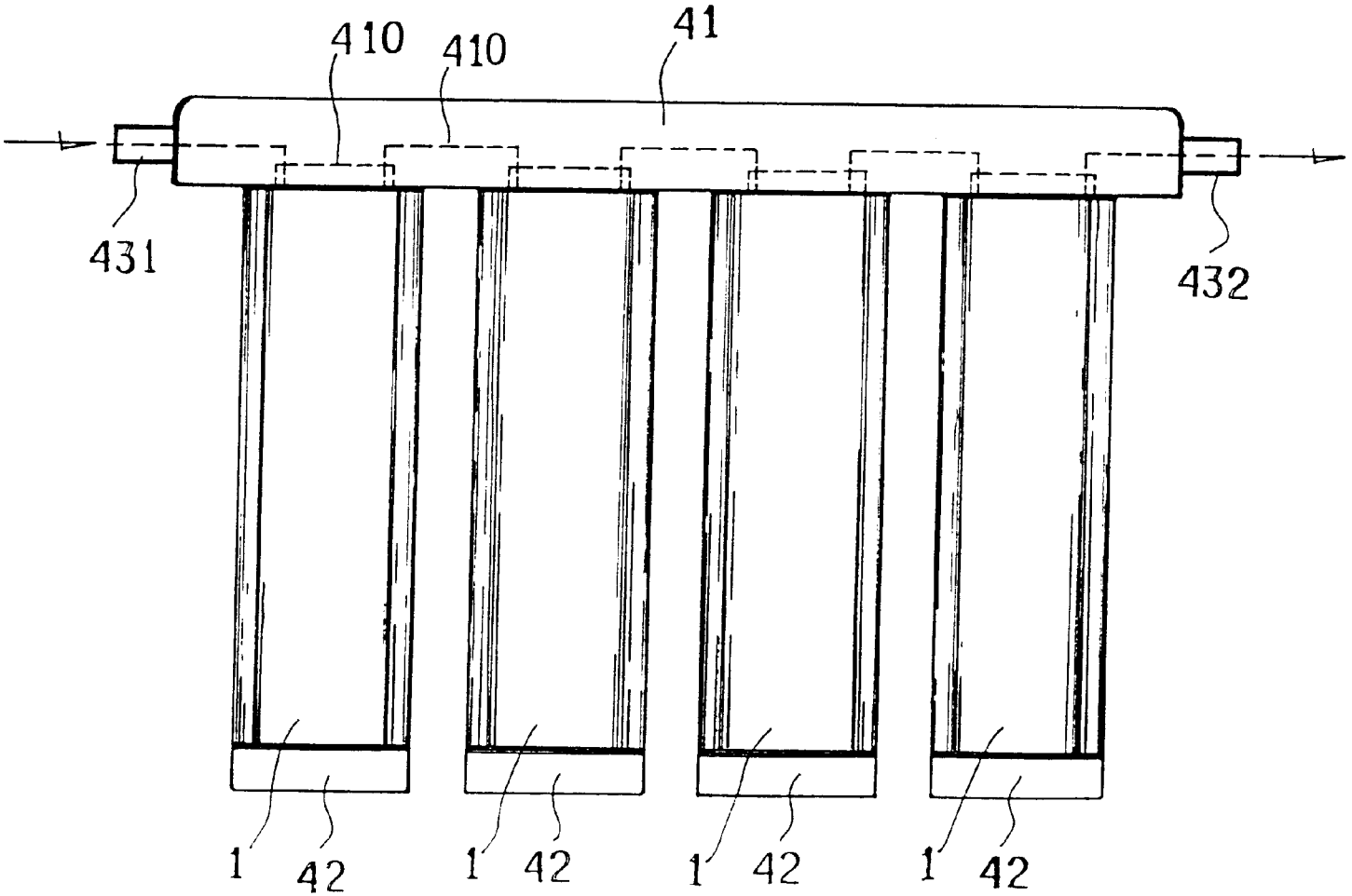
FIG. 8 shows still another embodiment of the present invention.

Moreover, as shown in FIG. 8, the front cover 41 is adapted such that a row of main bodies 1 are arranged on the front cover 41. For example, the front cover 41 is lengthened and a plurality of guiding slots are provided on the front cover 41. Therefore, a plurality of main bodies 1 are arranged in a row on the front cover 41.

Figure 2:
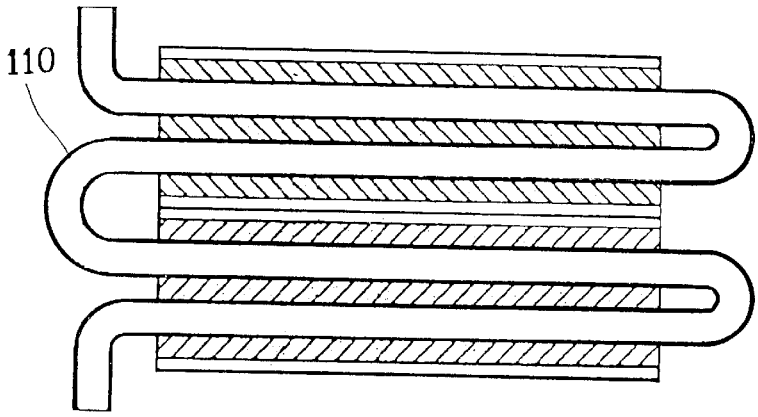
FIG. 2 shows another embodiment of the present invention.
Figure 3:
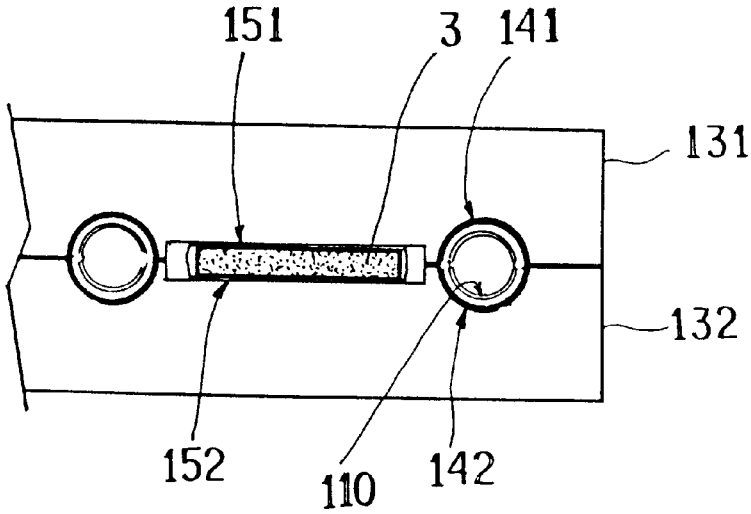
FIG. 3 shows still another embodiment of the present invention.

Moreover, as shown in FIGS. 2 and 3, the circulating conduit 11 is formed by an integral thermally conductive metal pipe 110 bent in a serpentine shape and heat exchanges with the main body 1. The main body 1 is composed of two symmetric units 131 and 132, which have hemispherical grooves 141 and 142 for receiving the metal pipe 110 and embedding grooves 151 and 152 for mounting the heating unit 3. The circulating conduit 11 is formed by an integral thermally conductive metal pipe 110 such that the resistance force to the fluid can be minimized. The two symmetric units 131 and 132 are assembled by screw or binding paste. Moreover, heat conducting paste can be applied to the interface between the hemispherical grooves 141 and 142 and the metal pipe 110 to conduct heat more efficiently.

Figure 4:
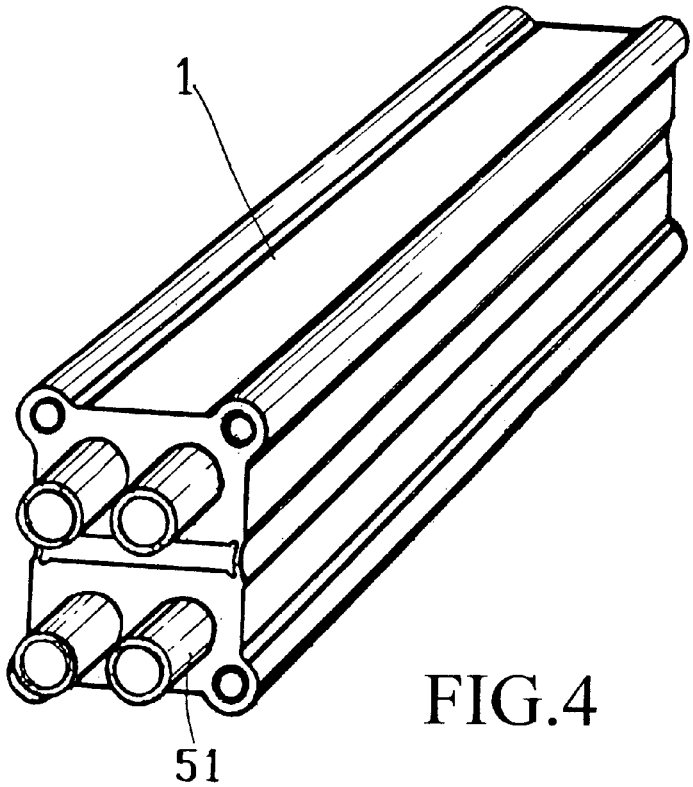
FIG. 4 shows still another embodiment of the present invention.
Figure 5:
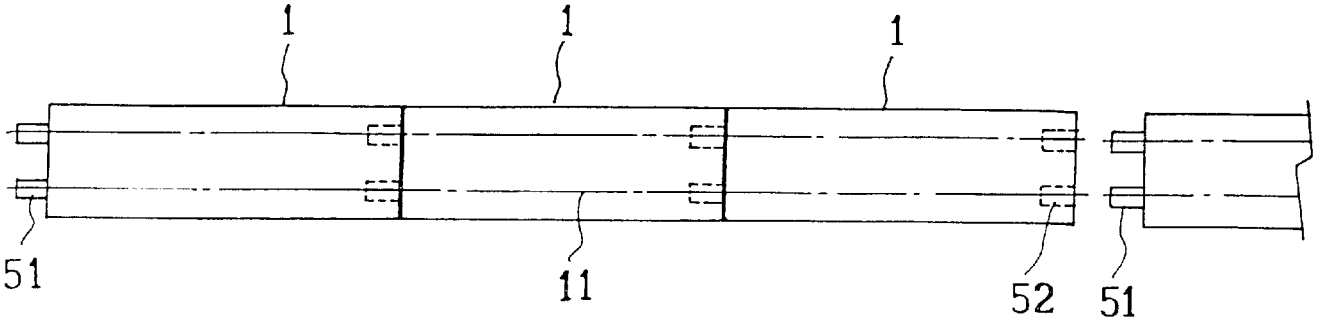
FIG. 5 shows still another embodiment of the present invention.

As shown in FIGS. 4 and 5, the outer end of the conduit 11 is provided with male coupling portion (coupling pipe 51) or female coupling portion (coupling hole 52) to facilitate the connection of multiple main body.

Figure 6:
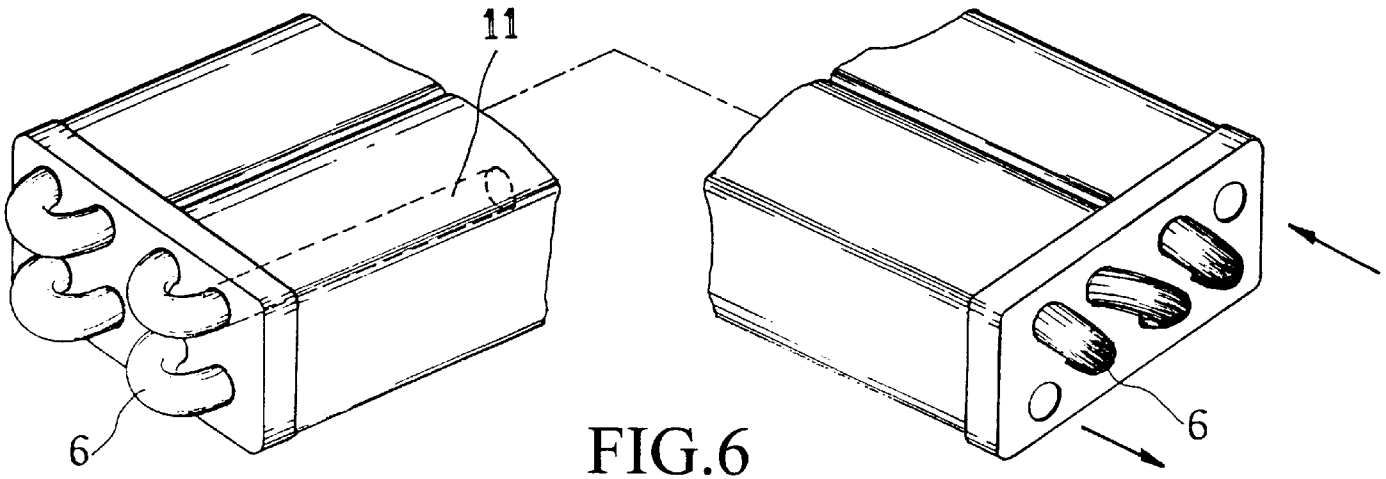
FIG. 6 shows still another embodiment of the present invention.
Figure 7:
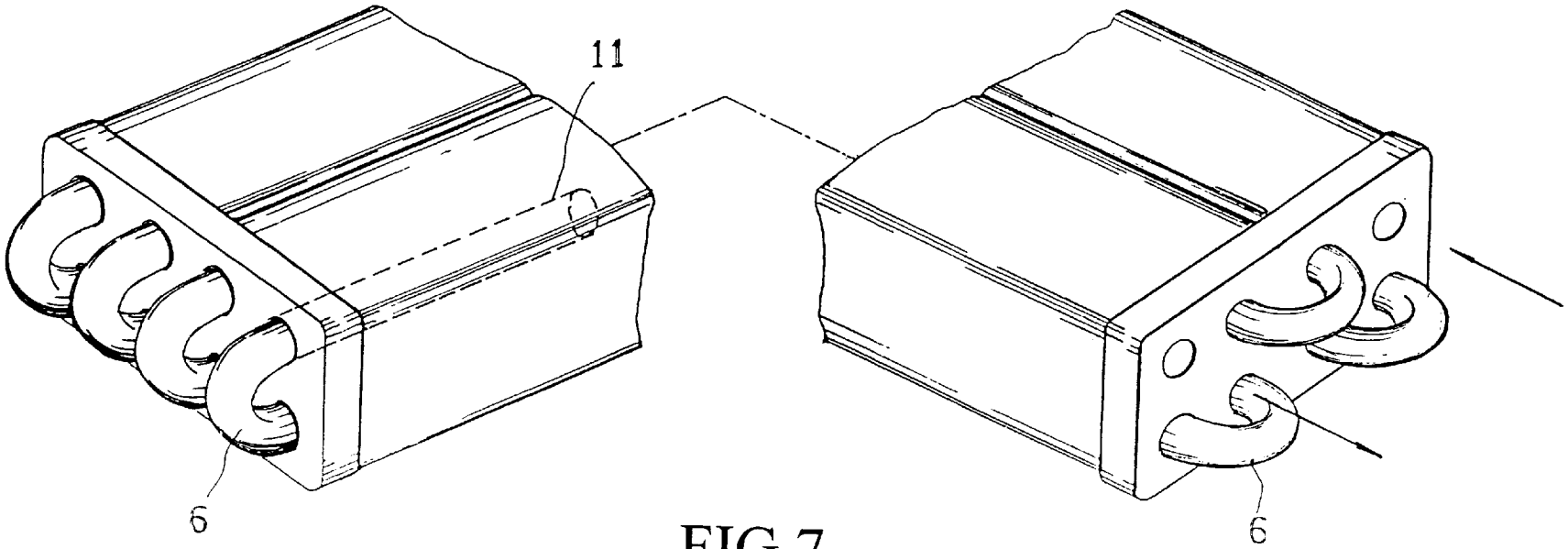
FIG. 7 shows still another embodiment of the present invention.

As shown in FIGS. 6 and 7, the outer end of the conduit 11 is joined by a U-shaped tube 6. Therefore, the fluid type heating apparatus can be flexibly connected in serial or parallel for various applications.

Moreover, the main body can be enclosed by heat insulation layer to prevent heat dissipation and the groove is sealed with paste for immersion application Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A fluid-type heating apparatus with safety seal comprising:

a metallic heat-exchanging main body;

a heating mechanism embedded within the metallic heat-exchanging main body;

a plurality of fluid conduits extended along a lengthwise direction of the metallic heat-exchanging main body;

grooves at a center of lateral sides of the metallic heat-exchanging main body and housing the heating mechanism as enclosed by an insulating layer;

a front cover at a front side of the metallic heat-exchanging main body;

a rear cover at a rear side of the metallic heat-exchanging main body;

a plurality of guiding slots in the front and rear covers, the plurality of guiding slots coupled to the plurality of fluid conduits to control fluid circulation; and, two deformable parts formed on the lateral sides of the metallic heat-exchanging main body beside the grooves.

2. The apparatus of claim 1, wherein the heat-exchanging main body comprises a top-side unit and a bottom-side unit symmetric to the top-side unit, the top-side and the bottom-side units housing an integrally formed serpentine-shaped pipe.

3. The apparatus of claim 1, wherein the plurality of fluid conduits have a U-shaped tube disposed at an end thereof.

4. The apparatus of claim 1, further comprising a plurality of threaded grooves on the metallic heat-exchanging main body and integrally formed with the metallic heat-exchanging main body.

5. The apparatus of claim 1, wherein the plurality of guiding slots in the front and rear covers are such that a plurality of metallic heat-exchanging main bodies, including the metallic heat-exchanging main body, are assembled with the front and the rear covers.

* * * * *